US008959681B2

(12) United States Patent
Richards

(10) Patent No.: US 8,959,681 B2
(45) Date of Patent: Feb. 24, 2015

(54) GROUND SENSOR CONTROL OF FOOT SECTION RETRACTION

(75) Inventor: Sandy M. Richards, Pershing, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 735 days.

(21) Appl. No.: 12/973,069

(22) Filed: Dec. 20, 2010

(65) Prior Publication Data

US 2012/0151678 A1 Jun. 21, 2012

(51) Int. Cl.

| | |
|---|---|
| ***A47B 7/00*** | (2006.01) |
| ***A61G 7/16*** | (2006.01) |
| ***A61G 7/00*** | (2006.01) |
| ***A61G 7/002*** | (2006.01) |
| ***A61G 7/012*** | (2006.01) |
| ***A61G 7/015*** | (2006.01) |
| ***A61G 7/018*** | (2006.01) |

(52) U.S. Cl.

CPC .. *A61G 7/16* (2013.01); *A61G 7/00* (2013.01); *A61G 7/002* (2013.01); *A61G 7/012* (2013.01); *A61G 7/015* (2013.01); *A61G 7/018* (2013.01); *A61G 2203/30* (2013.01); *A61G 2203/72* (2013.01); *A61G 2203/726* (2013.01); *A61G 2203/36* (2013.01); *A61G 2203/40* (2013.01)

USPC ..... 5/613; 5/600; 5/611; 5/616; 340/540

(58) Field of Classification Search

USPC ..... 5/611, 613, 424, 600, 618, 616, 624; 340/540

See application file for complete search history.

(56) References Cited

U.S. PATENT DOCUMENTS

| | | | | |
|---|---|---|---|---|
| 4,094,024 | A | 6/1978 | Benoit et al. | |
| 4,159,496 | A | 6/1979 | Stevens | |
| 4,227,269 | A | 10/1980 | Johnston | |
| 4,403,214 | A | 9/1983 | Wolar | |
| 4,425,673 | A | 1/1984 | Werner | |
| 4,534,077 | A | 8/1985 | Martin | |
| 4,628,556 | A | 12/1986 | Blackman | |
| 4,882,566 | A | 11/1989 | Koerber, Sr. et al. | |
| 5,468,216 | A * | 11/1995 | Johnson et al. | 5/616 |
| 5,611,096 | A | 3/1997 | Bartlett et al. | |
| 6,353,950 | B1 | 3/2002 | Bartlett et al. | |
| 6,601,251 | B2 | 8/2003 | Paul | |
| 6,841,953 | B2 | 1/2005 | Bastholm | |
| 6,904,631 | B2 | 6/2005 | Vrzalik et al. | |
| 6,907,630 | B2 | 6/2005 | Treon | |

(Continued)

FOREIGN PATENT DOCUMENTS

| | | | |
|---|---|---|---|
| DE | 102007018694 | 11/2008 | |
| EP | 1275328 A1 * | 1/2003 | A47C 20/04 |

OTHER PUBLICATIONS

European Search Report for EP 11 19 3865, dated Apr. 13, 2012.

*Primary Examiner* — Peter M Cuomo
*Assistant Examiner* — Brittany Wilson
(74) *Attorney, Agent, or Firm* — Barnes & Thornburg LLP

(57) ABSTRACT

A method and apparatus for controlling movement of members of a patient support apparatus by detecting obstructions to movement of members of the frame of the patient support apparatus and controlling the drives that move the members to prevent contact with the obstruction while achieving a desired position as quickly as possible. Proximity sensors positioned on member of the patient support apparatus at potential contact points prevents members of the patient support apparatus from contacting other members or obstructions such a floor, for example.

22 Claims, 6 Drawing Sheets

(56) References Cited

U.S. PATENT DOCUMENTS

| | | | | |
|---|---|---|---|---|
| 6,915,538 | B2 | 7/2005 | Treon | |
| 6,944,896 | B2 | 9/2005 | Treon | |
| 7,003,828 | B2 | 2/2006 | Roussy | |
| 7,076,818 | B2 | 7/2006 | Kummer et al. | |
| 7,208,896 | B2 | 4/2007 | Ford et al. | |
| 7,383,107 | B2 | 6/2008 | Fehr et al. | |
| 7,386,900 | B2 | 6/2008 | Lemire | |
| 7,472,237 | B1 | 12/2008 | Herbst et al. | |
| 7,472,437 | B2 * | 1/2009 | Riley et al. | 5/600 |
| 7,520,006 | B2 | 4/2009 | Menkedick et al. | |
| 7,676,866 | B2 | 3/2010 | Toms et al. | |
| 7,703,158 | B2 | 4/2010 | Wilker, Jr. et al. | |
| 7,834,768 | B2 | 11/2010 | Dixon et al. | |
| 7,932,690 | B2 | 4/2011 | Jones et al. | |
| 7,978,084 | B2 * | 7/2011 | Dixon et al. | 340/573.1 |
| 2006/0244466 | A1 | 11/2006 | Call et al. | |
| 2008/0083065 | A1 * | 4/2008 | Bautovich | 5/424 |
| 2008/0189856 | A1 | 8/2008 | Toms et al. | |
| 2009/0064414 | A1 | 3/2009 | Andersen et al. | |
| 2009/0109025 | A1 | 4/2009 | Riley et al. | |
| 2010/0030926 | A1 | 2/2010 | Roussy | |
| 2012/0137439 | A1 * | 6/2012 | Heimbrock | 5/618 |

* cited by examiner

GROUND SENSOR CONTROL OF FOOT SECTION RETRACTION

BACKGROUND

The present disclosure is related to a patient support apparatus having frame and deck members that move relative to one another. More specifically, the present disclosure is related to a patient support apparatus having sensors which detect when frame and deck members encounter obstructions and a control system that modifies movement of the patient support apparatus based on the information from the sensors.

Patient support apparatuses such as hospital beds, for example, may include frames that move relative to one another, and deck sections that move relative to a frame. The patient support apparatus may include a lower frame, also known as a base frame, and an upper frame which moves relative to the lower frame. The upper frame may be supported on various structures which cause the upper frame to move relative to the lower frame. In some cases, the upper frame is supported on two hydraulic cylinders and is movable relative to the lower frame when the hydraulic cylinders are extended and retracted. In some cases, the upper frame is supported on one or more lift arms that are driven by hydraulic cylinders or motorized actuators. Movement of the lift arms causes the upper frame to move relative to the lower frame. If one of the drives or hydraulic cylinders is driven at a different rate as compared to the other of the drive or hydraulic cylinders, the upper frame may move to a tilt position as compared to the lower frame.

Patient support deck sections are supported on an upper frame and pivotable relative to the upper frame to raise or lower portions of a patient's body. For example, a head deck section may rise relative to the upper frame to incline the patient's torso. In some cases, a thigh deck section that supports a portion of the patient's seat and thighs may also pivot relative to the upper frame. In some cases, a foot deck section may be pivotable relative to a thigh deck section to change the angle between the thigh deck section and the foot deck section. It is also known to have a foot deck section that is extendable and retractable to change the length of the foot deck section.

In some patient support apparatuses such as the Hill-Rom® TotaleCare® bed, for example, the bed is capable of being moved to a position in which a patient may exit, or egress, from the foot end of the bed when the bed has been moved to a chair configuration. This position is generally known as a "chair egress position." In the chair egress position, the upper frame may be tilted relative to the lower frame, the foot deck section may be pivoted relative to the thigh deck section, and the head deck sections may be pivoted relative to the upper frame. The positions of the various frames and deck sections are monitored by position sensors that provide feedback to a controller to confirm that the frame members and the deck sections are in positions that will not result in contact between frame members and deck section members or between the frame members and deck section members and the floor.

In some cases, potentiometers are connected between two members that move relative to one another. The potentiometers are used to determine the relative movement between the members. For example, a potentiometer may be positioned between a left arm and a lower frame member to determine the amount of movement of the left arm relative to the lower frame. In some cases, a potentiometer is used to measure the length of a hydraulic cylinder or motorized actuator. The amount of movement of the lift arm relative to lower frame, or the length of the cylinder or motorized actuator, are used to determine a relative position of two members of the patient support apparatus. It is also known to use accelerometers to determine the attitude of a frame number or deck section member with the controller utilizing the attitude of the various deck section members and frame members to determine the orientation of the various members relative to one another.

The use of sensors to determine the relative position of frame members and deck section members requires a designer to utilize the kinematic relationship of the various frame members and deck section members to develop logic in the controller to prevent movement to of frame members or deck section members to unacceptable positions. Such relationships are subject to variations in manufacturing tolerances and the accuracy of the sensors used to measure the relationships. These limitations sometimes cause designers of the patient support apparatuses to limit the range of movement of frame members and deck section members to be sure that any movement is outside of any variation which may be expected from sensor limitations or manufacturing variations.

SUMMARY

According to one aspect of the present disclosure, a patient support apparatus includes a lower frame, an upper frame, a first sensor positioned on one of the upper frame and the lower frame, and a control system. The upper frame is movable relative to the lower frame. The first sensor has a sensing field and transmits a signal when the first sensor detects a body in the sensing field. The control system includes a controller coordinating movement of the upper frame relative to the lower frame. The controller receives a signal from the first sensor and responds to the first sensor to control movement of the upper frame.

The first sensor may be positioned such that the other of the upper frame and lower frame that the first sensor is not positioned on is the body detected by the first sensor when movement the upper frame relative to the lower frame causes the other of the upper frame and lower frame that the first sensor is not positioned on is in the sensing field.

The controller may modify the movement of the upper frame relative to the lower frame if movement of the upper frame is being requested and the first sensor detects a body in the sensing field.

The patient support apparatus may further comprise a lift system coupled to the control system. When present, the lift system may move the upper frame relative to the lower frame. The control system may control the movement of the lift system. The lift system may be operable to tilt the upper frame relative to the lower frame.

The first sensor may be positioned on the upper frame to detect the floor when the upper frame approaches the floor.

The control system may be operable to stop operation of portions of the patient support apparatus when the first sensor detects a body in the sensing field. In some embodiments, the control system may be operable to change the speed of operation of portions of the patient support apparatus when the first sensor detects a body in the sensing field.

In some embodiments, the first sensor forms a magnetic field. In other embodiments, the first sensor forms a light field.

In some embodiments, the patient support apparatus further comprises a patient support deck section supported on the upper frame and a second sensor positioned on the patient support deck, the patient support deck section movable relative to the upper frame.

In some embodiments, the controller modifies the movement of the upper frame relative to the lower frame if movement of the upper frame is being requested and the first sensor detects a body in the sensing field.

In some embodiments, the controller modifies the movement of the patient support deck section relative to the upper frame if movement of the patient support deck section is being requested and the second sensor detects a body in the sensing field.

According to another aspect of the present disclosure, a patient support apparatus comprises a base frame, an upper frame movable relative to the base frame, and a plurality of deck sections supported on the upper frame. The deck sections are movable relative to the upper frame. At least one deck section that is both pivotable relative to the upper frame and variable in size. The patient support apparatus also includes a first sensor positioned on one of the frames and a second sensor positioned on the at least one deck section that is both pivotable relative to the upper frame and variable in size. The patient support apparatus also includes a control system including a controller coordinating movement of the upper frame relative to the lower frame and coordinating movement of the deck sections relative to the upper frame. The controller receives a signal from the first sensor and responds to the first sensor to control movement of the upper frame if the first sensor detects that the upper frame is proximate the base frame. The controller further receives a signal from the second sensor and responds to the second sensor to control movement of the at least one deck section that is both pivotable relative to the upper frame and variable in size if the second sensor detects that the at least one deck section that is both pivotable relative to the upper frame and variable in size is proximate an obstruction.

The second sensor may detect that the at least one deck section that is both pivotable relative to the upper frame and variable in size is proximate the floor.

The patient support apparatus may further include a first drive to pivot the at least one deck section that is both pivotable relative to the upper frame and variable in size relative to the upper frame. The patient support apparatus may still further include a second drive to extend and retract said at least one deck section that is both pivotable relative to the upper frame and variable in size. Movement of one of the first and second drives may be interrupted if the second sensor detects an obstruction, while the movement of the other of the first and second drives is continued.

In some embodiments, at least one deck section that is both pivotable relative to the upper frame and variable in size is a foot deck section. The foot deck section may continue to retract in size if the second sensor detects an obstruction while the pivoting of the foot deck section is interrupted until the second sensor no longer detects an obstruction.

The obstruction detected may be the floor supporting the patient support apparatus.

The patient support apparatus may further comprise at least two drives that move the upper frame relative to the base frame with the controller controlling operation of the at least two drives. In some embodiments, operation of one of the at least two drives that move the upper frame relative to the base frame is interrupted while the foot deck section continues to retract in size if the second sensor detects an obstruction. In some embodiments, the one of the at least two drives that move the upper frame relative to the base frame resumes operation when the second sensor no longer detects an obstruction.

According to yet another aspect of the present disclosure, a method of controlling movement of portions of a patient support apparatus includes receiving an input signal indicative of a desired position of a member of the patient support apparatus. The method also includes activating a driver to move the member toward the desired position and monitoring a proximity sensor detecting the proximity of the member to an obstruction. The method also includes altering the operation of the driver if the member is determined to be proximate an obstruction.

In some embodiments, the member is variable in size and the patient support apparatus includes a first driver operable to change the size of the member and a second driver to move the member and the method includes the step of changing the size of the member during movement to the desired position. The method may further include varying the speed of the first driver during movement to the desired position. The step of varying the speed may include the step of stopping the first driver during movement to the desired position. The step of varying the speed of the first driver may include varying the speed of the first driver if the proximity sensor detects that the first member is proximate an obstruction.

The step of varying the speed of the first driver may include varying the speed of the first driver if the proximity sensor detects that the member is proximate the floor.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
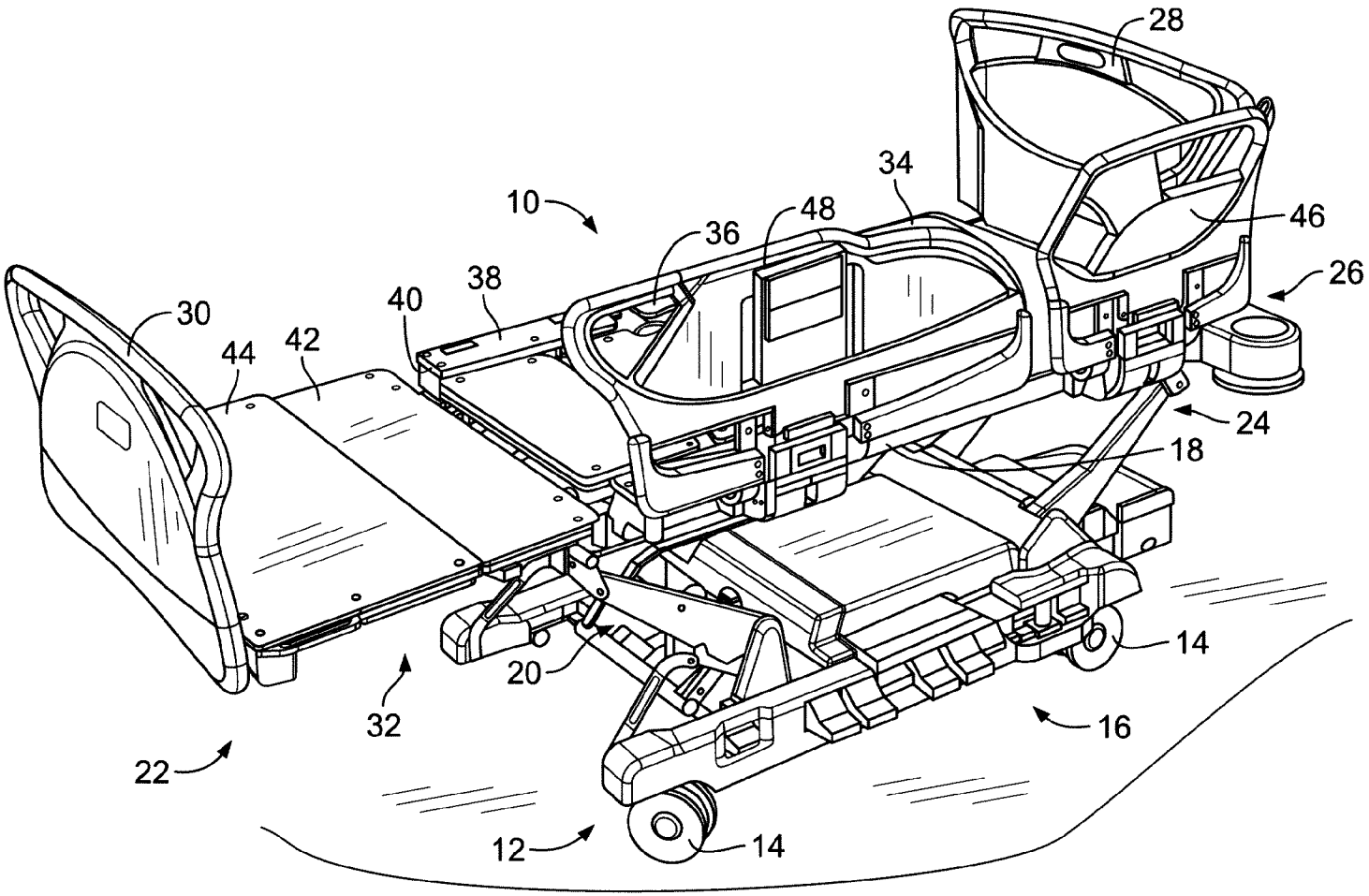
FIG. 1 is a perspective view of a patient support apparatus including a lower frame, an upper frame movable relative the lower frame, and a number of deck sections movable relative to the upper frame.
Figure 12:
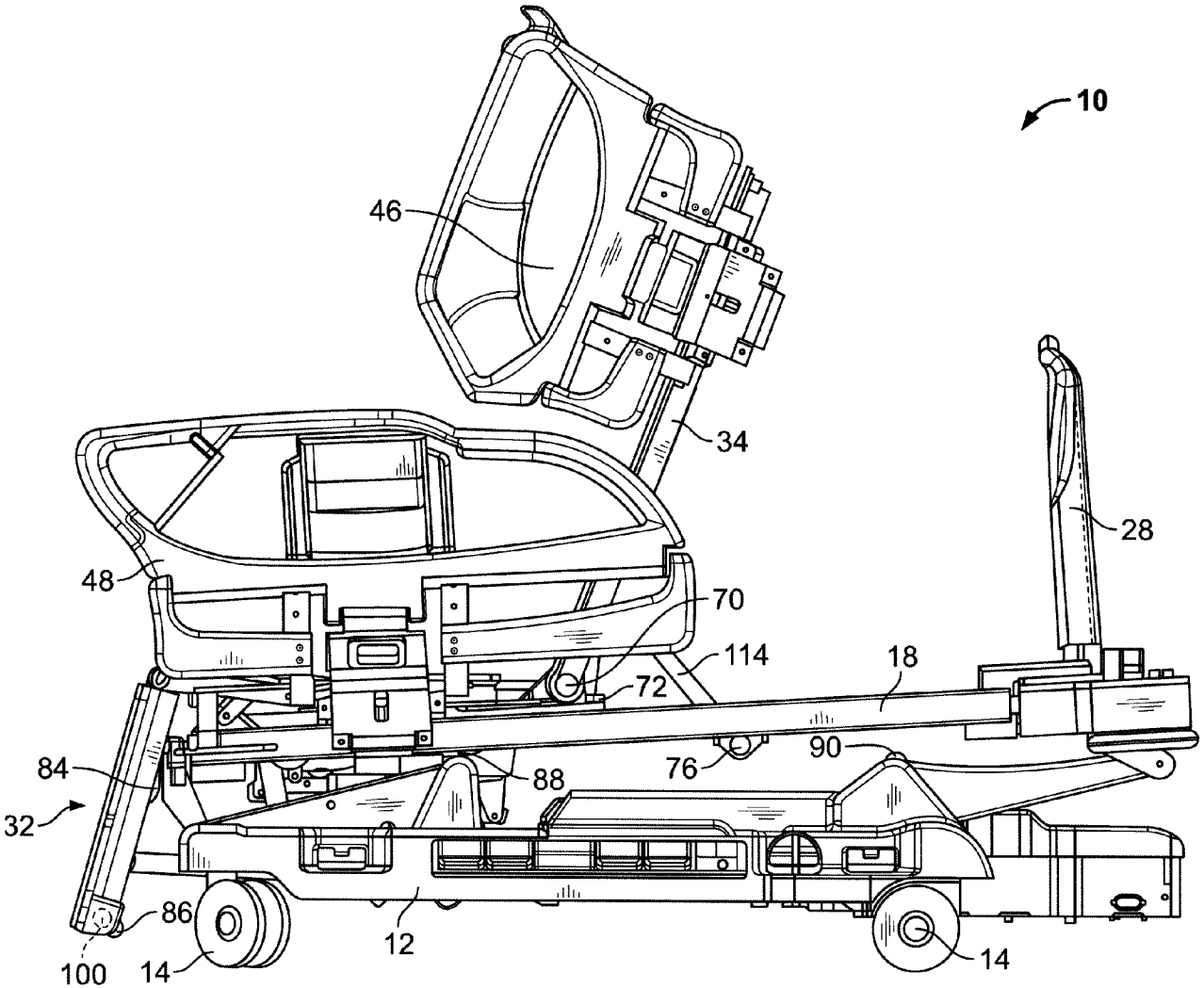

According to the present disclosure a patient support apparatus 10, illustratively embodied as a hospital bed, is movable between a horizontal bed position as shown in FIG. 1 and a chair egress position as shown in FIG. 12. Referring again now to FIG. 1, the hospital bed 10 includes a lower frame 12 supported on a number of casters 14 above the floor 16. The hospital bed 10 also includes an upper frame 18 movable vertically relative to the lower frame 12. The upper frame 18 is supported on a pair of lift arms 20 that are pivotally coupled to the upper frame 18 near the portion of the upper frame nearest a foot end 22 of the hospital bed 10. The upper frame 18 is also supported on a pair of lift arms 24 that are pivotally connected to the upper frame 18 near the portion of the upper frame 18 nearest a head end 26 of the hospital bed 10. It should be understood that the reference to the foot end 22 and head end 26 of the hospital bed 10 is provided for orientation only and does not refer to any specific location or portion of the hospital bed 10.

The hospital bed 10 includes a head deck section 34 which is pivotable relative to the upper frame 18 and a seat deck section 36 which is fixed to the upper frame 18. In addition, a thigh deck section 38 is pivotably coupled to the upper frame 18 such that the end 40 of the thigh deck section 38 nearest the foot end 22 of the hospital bed 10 lifts relative to the upper frame 18. A foot deck section 32 is pivotally coupled to the thigh deck section 38 near the end 40 of the thigh deck section 38. The foot deck section 32 includes a base 42 and an extension 44 that moves relative to the base 42 to increase the length of the foot deck section 32. The hospital bed 10 also includes a head panel 28 supported on the upper frame 18 and a footboard 30 supported on the extension 44 of the foot deck section 32. A head side rail 46 is shown in FIG. 1 is positioned on the patient left side of the head deck section 34 so that the head side rail 46 moves with the head deck section 34. A main side rail 48 is supported from the upper frame 18 and movable between a raised position as shown in FIG. 1 and a lowered position (not shown). The head side rail 46 is also movable between the raised position shown in FIG. 1 and a lowered position (not shown). While not shown in the figures, the hospital bed 10 also includes a main side rail and a head side rail position on the patient right side of the hospital bed 10 and similar to the head side rail 46 and main side rail 48.

Figure 2:
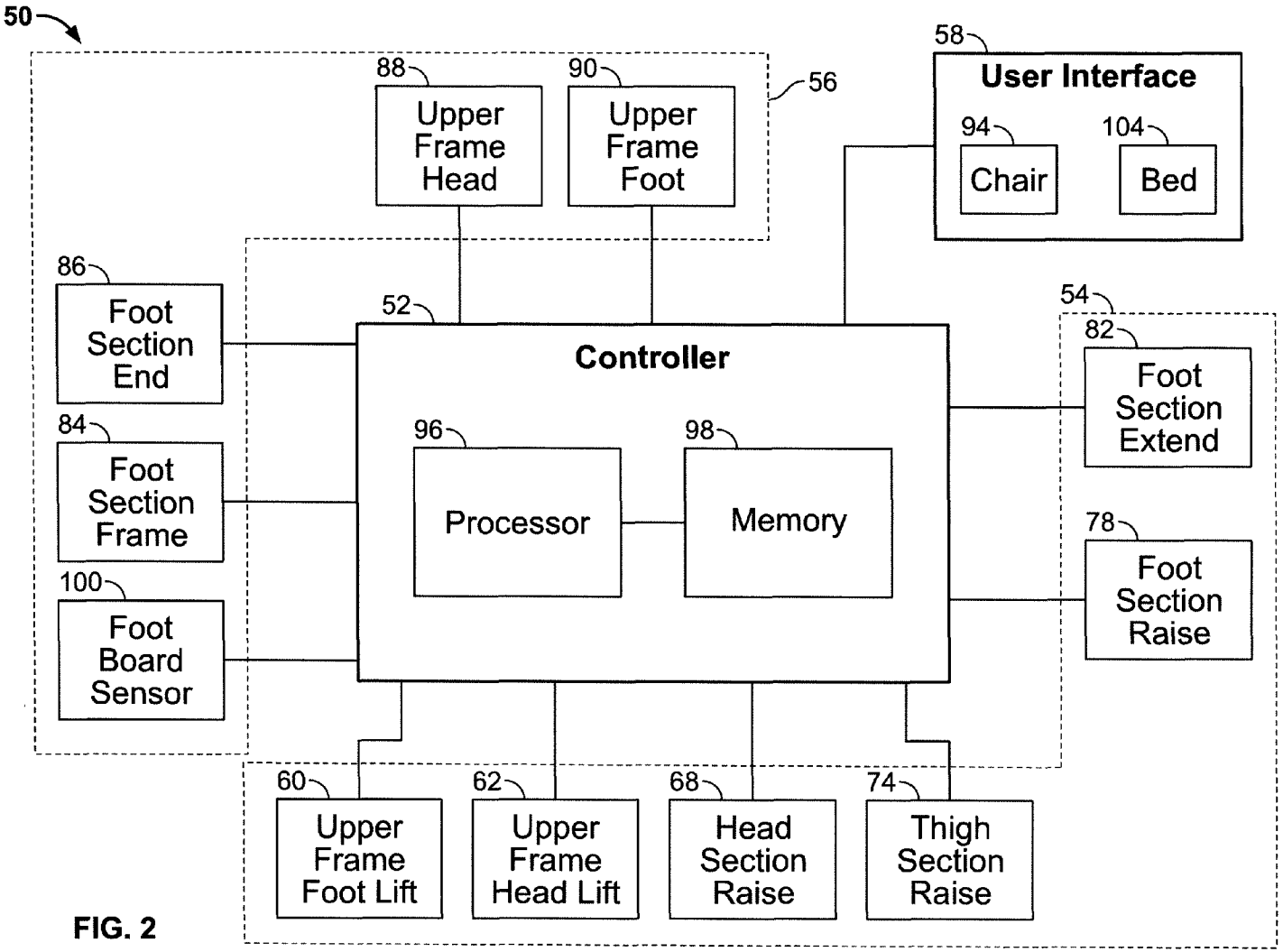
FIG. 2 is a block diagram of the control system of the patient support apparatus of FIG. 1.

Referring to a block diagram of a control system 50 that includes the functionality to control movement of the upper frame 18 relative to the lower frame 12, the head deck section 34, the thigh deck section 38, and the foot deck section 32 shown in FIG. 2, the control system 50 is shown with a controller 52, a drive system 54, a sensor system 56, and a user interface 58. The drive system 54 includes an upper frame foot lift drive 60 which actuates the lift arms 20 to move the foot end 22 of the upper frame 18 vertically relative to the lower frame 12. The drive system 54 also includes an upper frame head lift drive 62 that actuates the lift arms 24 to move the head end 26 of the upper frame 18 vertically relative to lower frame 12. The upper frame head lift drive 62 and upper frame foot lift drive 60 operate together to move the upper frame 18 between a raised position as shown in FIG. 3 and a lowered position as shown in FIG. 4.

Figure 4:
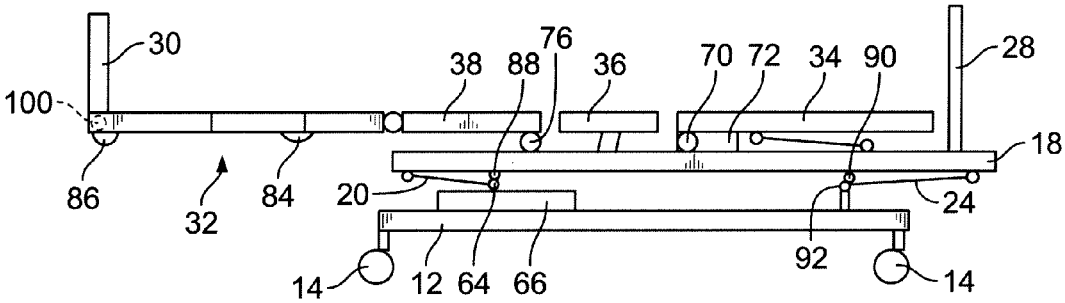
FIG. 4 is a diagrammatic view similar to FIG. 3 with the upper frame in a fully lowered position relative to the lower frame.
Figure 5:
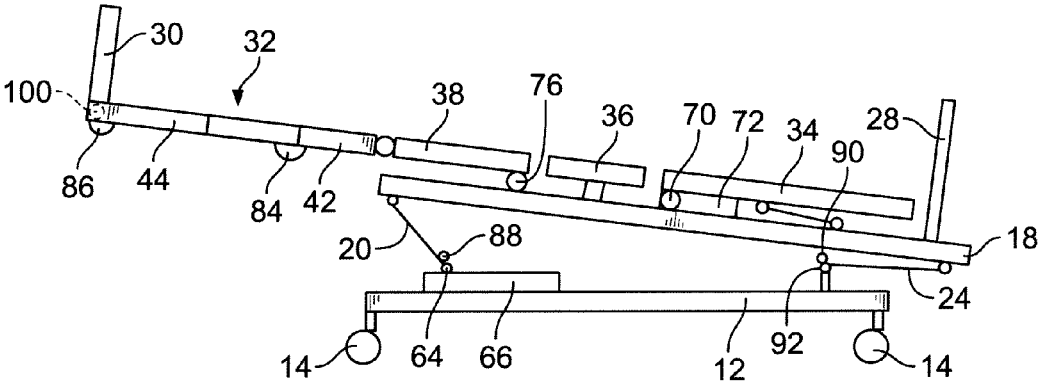
FIG. 5 is a diagrammatic view of the patient support apparatus in a forward tilt position with the head end of the upper frame lower than the foot end of the upper frame.
Figure 6:
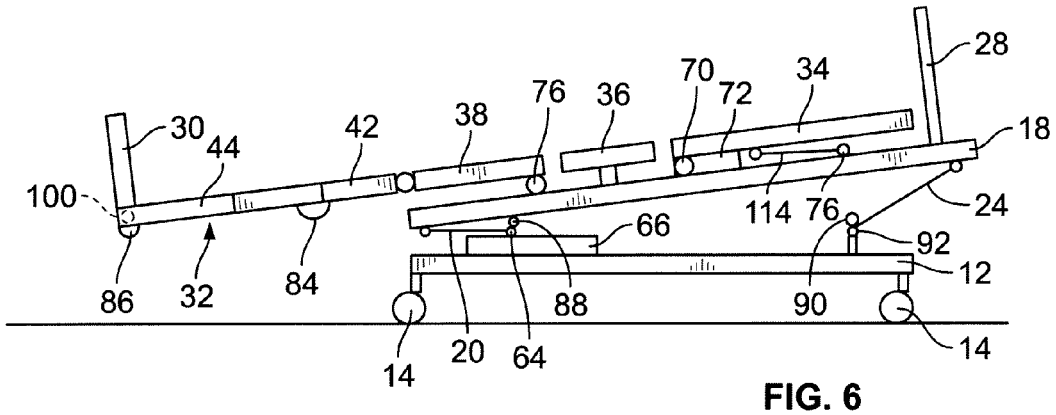
FIG. 6 is a diagrammatic view of the patient support apparatus in a reverse tilt position with the foot end of the upper frame lower than the head end of the upper frame.

The upper frame head lift drive 62 and the upper frame foot lift drive 60 may operate independently to place the upper frame 18 in a tilt position as shown in FIG. 5 where the head end 26 of the upper frame 18 is lower than the foot end 22 of the upper frame 18. The upper frame may also be placed in a reverse tilt position as shown in FIG. 6 where the foot end 22 is lower than the head and 26 of the upper frame 18. As shown in FIG. 3, the lift arms 20 pivot about a pivot 64. The pivot 64 is supported in a guide 66 on lower frame 12 and translates along the guide 66 between a first position shown in FIG. 3 when the foot end 22 of the upper frame 18 is in a fully raised position and a second position shown in FIG. 4 when a foot and 22 of the upper frame 18 is in a lowered position. The translation of pivot 64 limits the amount of movement of the upper frame 18 along the longitudinal length of the hospital bed 10 during movement of the upper frame 18 between the lowered position of FIG. 4 and the raised position of FIG. 3.

Figure 3:
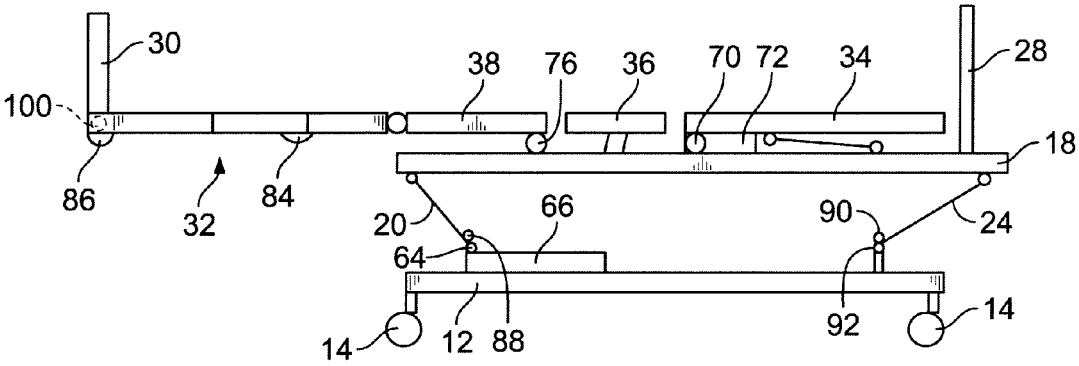
FIG. 3 is a diagrammatic view of the kinematic relationships of the frame members and deck section members of the patient support apparatus of FIG. 1, with the deck section members positioned such that the patient support apparatus is in a horizontal bed position and the upper frame is in a fully raised position relative to the lower frame.

The drive system 54 also includes a head section raise drive 68 which moves the head deck section 34 between the lowered position shown in FIG. 3 and a raised position as shown in FIG. 12. The head deck section 34 pivots at about a pivot 70. The pivot 70 is supported in a guide 72 and translates along the length of the upper frame 18 as the head section moves between the lowered position and the raised position. An arm 114 is pivotably coupled to the head deck section 34 and the upper frame 18 and pivotable around a pivot 76. As the pivot 70 moves along the guide 72, the arm 114 acts urges the head deck section 34 to raise relative to the upper frame 18.

Figure 11:
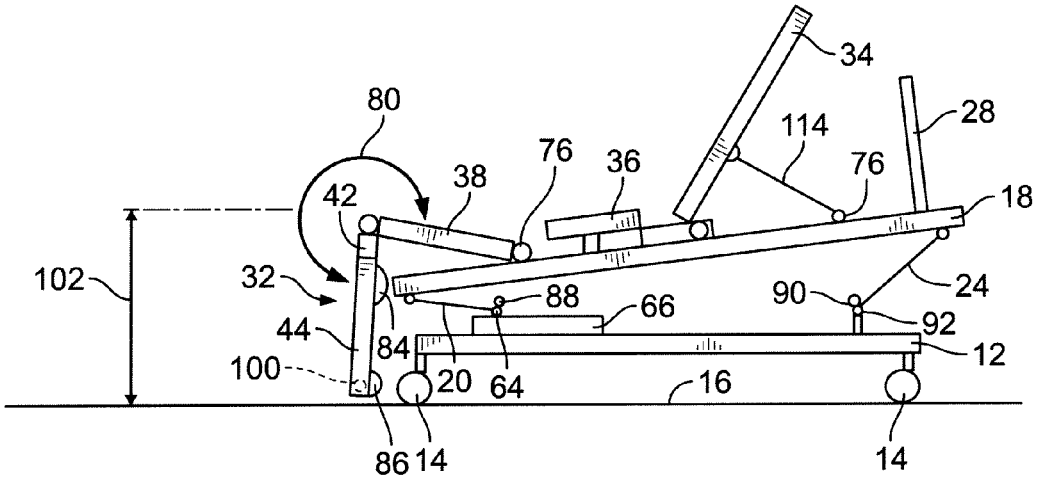

The drive system 54 also includes a thigh section raise drive 74 that lifts the foot and 40 of the thigh deck section 38 relative to the upper frame 18. The thigh deck section 38 pivots about a pivot 76 that is fixed to the upper frame 18. The drive system 54 also includes a foot deck section raise drive 78 that pivots the foot deck section 32 relative to the thigh deck section 38. The foot deck section 32 is movable from a position where the thigh deck section 38 and foot deck section 32 form a single support surface and a position where the foot deck section 32 has pivoted relative to the thigh deck section 38 Form an angle 80 of approximately 270° as shown in FIG. 11. The drive system 54 also includes a foot section extension drive 82 that is coupled between the base 42 and the extension 44 of the foot deck section 32 to move the extension 44 to a fully extended position shown in FIG. 3. The extension 44 may be retracted relative to the base 42 to a fully retracted position as shown in FIGS. 11 and 12.

Each of the drives in the drive system 54 includes a potentiometer that measures the length of the respective drives 60, 62, 68, 74, 78, and 82. With the length of each of the drives 60, 62, 68, 74, 78, and 82 being known, the position of all of the components of the hospital bed 10 may be determined based on the length of the various members, the distance between various pivot points, and various feature dimensions so that the kinematic relationship of all of the frame members and deck section members of the hospital bed 10 can be related in an algorithm used by the controller 52.

The control system 50 further includes a sensor system 56 that includes a number of sensors 84, 86, 88, 90, or 100 that are positioned to detect the proximity of one of the frame members or deck section members to other frame members or deck section members. The sensors 84, 86, 88, 90, or 100 of the sensor system 56 may also detect the proximity of one of the frame members to an external structure such as the floor, for example. In the illustrative embodiment, the sensors 84, 86, 88, 90, or 100 are field sensors which output an electromagnetic signal and monitor for reflection of the emitted signal to determine if the signal is being reflected by an obstruction. A foot section frame sensor 84 is positioned on the lower side of the base 42 of the foot deck section 32 as shown in FIG. 3. The sensor 84 is positioned to detect the upper frame 18 when the foot deck section 32 is lowered relative to the thigh deck section 38. The sensor system 56 also includes a foot section end sensor 86 positioned on the lower side of the extension 44 of the foot deck section 32 near the foot end 22 of the foot deck section 32. The foot section end sensor 86 signals the controller 52 when the sensor 86 detects that the foot deck section 32 is in proximity to the floor 16.

The sensor system 56 also includes an upper frame foot sensor 88 and an upper frame head sensor 90, with each of the sensors 88 and 90 being positioned on the lower frame 12 and positioned to detect when the upper frame 18 is proximate the pivot 64 of the foot lift arms 20 or a pivot 92 of the lift arms 24. The sensors 88 and 90 near the respective pivots 64 and 92 in the illustrative embodiment provide a signal to the controller 52 if the upper frame 18 comes is proximate the pivots 64 and 92. The controller 52 responds to the signals from the sensors 88 and 90 by interrupting movement of the upper frame 18 by stopping the operation of the upper frame foot lift drive 60 and upper frame head lift drive 62.

As described above, each of the drives 60, 62, 68, 74, 78, and 82 include potentiometers which permit the controller 52 to monitor the position of the various frame members and deck section members. The sensors 84, 86, 88, and 90 are used by the controller 52 to determine the proximity of the upper frame 18 to the lower frame 12 or the foot deck section 32 to the upper frame 18 and floor 16. Because the sensors 84, 86, 88, and 90 detect the actual presence of the adjacent frame members or the floor 16, the controller 52 may reliably position the upper frame 18 and foot deck section without concern for variations in the accuracy of the potentiometers or manufacturing variances in the production of the frame members and deck section members of the hospital bed 10. This is especially useful when the hospital bed 10 is moved from the horizontal position of FIG. 1 to the chair egress position of FIG. 12.

For example, in the illustrative embodiment, the user interface 58 includes a user input device 94 that may be activated by a user to indicate a desire of the user to move the hospital bed 10 to the chair egress position. The user input device 94 may be activated regardless of the position of the upper frame 18 and deck sections 34, 36, 38, and 32. The signal from the user input device 94 is received by the controller 52 and considered by a processor 96 of the controller 52. The processor 96 is coupled to the memory device 98 that includes instructions that cause the processor 96 to operate the drives 60, 62, 68, 74, 78, and 82 to move the foot deck section 32 to the lowered position, the head deck section 34 to the raised position, the thigh deck section 38 to a slightly inclined position, and the upper frame 18 to a reverse tilt position. During the movement to the chair egress position described above, the processor 96 will monitor a footboard sensor 100 to determine if the footboard 30 is present on the foot deck section 32. The footboard 30 must be removed from the foot deck section 32 before the hospital bed 10 will move to the full chair egress position.

Figure 7:
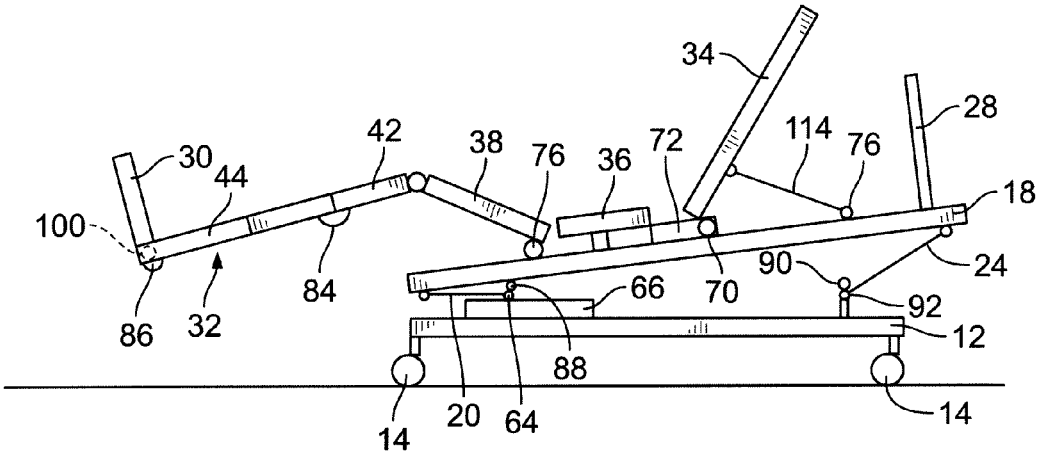
FIG. 7 is a diagrammatic view of the patient support apparatus in the reverse tilt position with a head deck section raised relative to the upper frame, the thigh deck section raised relative to the upper frame, foot deck section lowered relative to the thigh deck section.

As one example, if a user were to activate the user input device 94 when the hospital bed 10 is in the position shown in FIG. 4, the upper frame head lift drive 62 would be activated to raise the head and 26 of the upper frame 18. Depending on the position of the lift arms 20, as the head and 26 of the upper frame 18 is raised, the upper frame 18 may come into close proximity to the pivot 64. If the presence of the upper frame 18 is detected by the sensor 88, then the controller 52 will cause the upper frame foot lift drive 60 to raise the foot and 22 of the upper frame 18 slightly to prevent contact between the upper frame 18 and the pivot 64. During the progression from the position shown in FIG. 4, the upper frame 18 will achieve a reverse tilt position such as that shown in FIG. 6. During continued activation of the user input device 94, the thigh deck section 38 will raise relative to the upper frame 18 is shown in FIG. 7. During movement of the thigh deck section 38, the foot deck section 32 will lower relative to the thigh deck section 38 as shown in FIG. 7. Additional movement of the foot deck section 32 relative to the thigh deck section 38 will result in a configuration of the hospital bed 10 similar to that shown in FIG. 8.

Figure 8:
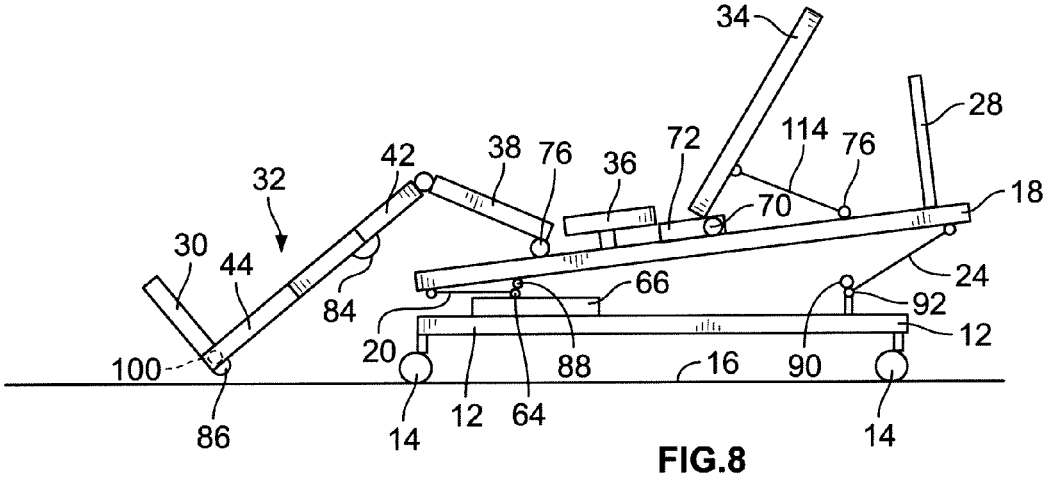
FIG. 8 is a diagrammatic view similar to FIG. 7 with the upper frame the lowered relative to the lower frame such that the foot end of the foot deck section is in close proximity to the floor.
Figure 9:
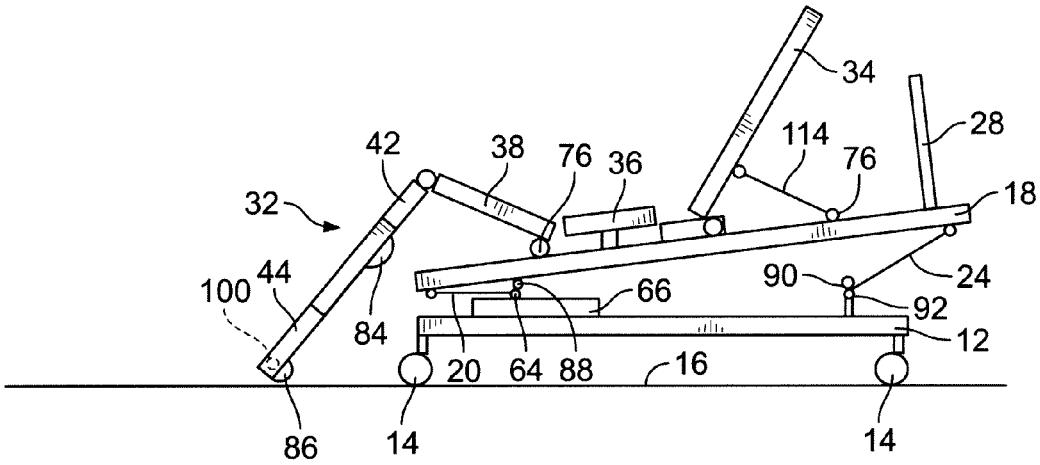
FIGS. 9-12 are diagrammatic views illustrating the progression of the movement of the upper frame and deck section members of the patient support apparatus from the position shown in FIG. 8 to a chair egress position.
Figure 10:
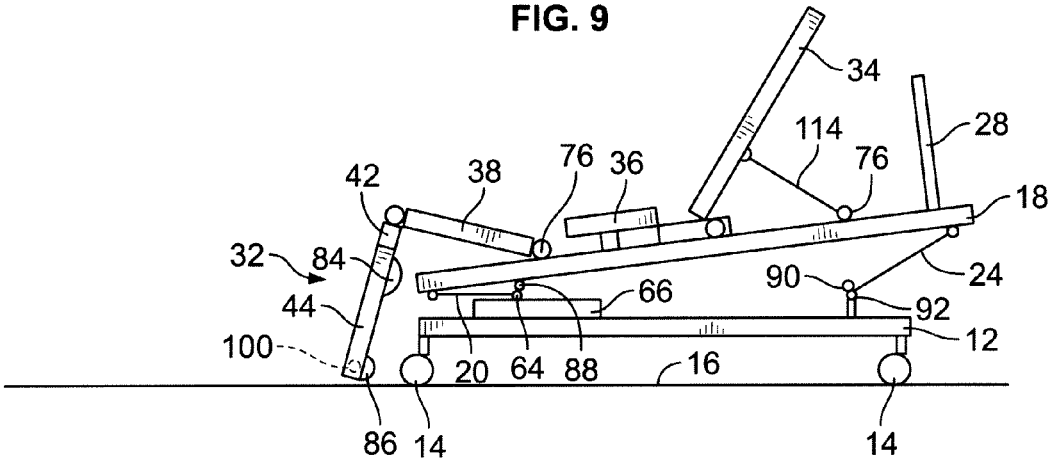

In the chair position shown in FIG. 8, the patient is supported in a position that is similar to a reclining chair. The user, such as a caregiver, will be prompted to remove the footboard 30 before the hospital bed 10 will progress to the chair egress position. Once the footboard 30 is removed, continued activation of the user input device 94 will cause the end of the foot deck section 32 to come in close proximity to the floor 16. Upon detection of the floor 16 by the sensor 86, the processor 96 of the controller 52 will modify the operation of the foot section extension drive 82, foot deck section raise drive 78, and upper frame foot lift drive 60 to move the hospital bed 10 to the chair egress position without having the foot deck section 32 come in contact with the floor 16. For example, as the foot deck section 32 pivots relative to the thigh deck section 38, the foot section extension drive 82 will be signaled to retract the extension 44 of the foot deck section 32. The processor will cease to operate the foot section raise drive 78 until the extension 44 is retracted sufficiently such that the sensor 86 does not detect the floor 16. Additional movement of the foot deck section 32 relative to the thigh deck section 38 will be continued until the sensor 86 began detects the proximity of the foot deck section 32 with the floor 16.

The intermittent operation of the foot deck section raise drive 78 will continue until the foot deck section 32 comes in proximity with the upper frame 18 as detected by the sensor 84. If the foot deck section 32 is fully pivoted relative to the thigh deck section 38 and in proximity to the upper frame 18, the upper frame foot lift drive 60 is raised until the sensor 86 no longer detects proximity to the floor 16. Once the foot deck section 32 is fully retracted with the extension 44 retracted relative to the base 42, additional actuation of the user input device 94 will cause the upper frame foot lift to be activated to lower the foot and 22 of the upper frame until the floor 16 is detected by the sensor 86. Utilizing this approach, the height 102 of the thigh deck section 38 relative to the floor 16 is minimized without reliance on the potentiometers of the drives 60, 62, 68, 74, 78, and 82.

In another example, movement of the hospital bed 10 to a tilt position such as that shown in FIG. 5, the sensor 90 positioned on the pivot 92 will detect the proximity of the upper frame 18 as the head and 26 of the upper frame 18 is lowered. The controller 52 will then continue to operate the upper frame head lift drive 62 to raise the foot and 22 of the upper frame 18 until the appropriate tilt angle is reached. The tilt angle may be determined by comparing the potentiometer readings of the upper frame foot lift drive 60 and upper frame head lift drive 62. The use of the sensor 90 causes the controller 52 to move the upper frame 18 to a position in which the head and 26 of the upper frame 18 is as low as possible without having to compensate for variations in the potentiometers in the drives 60 and 62 or manufacturing variations in the frame members of the hospital bed 10.

The controller 52 is also operable to utilize the signal from the foot section end sensor 86 when the hospital bed 10 is moved out of the chair egress position to the horizontal bed position. For example, if a user selects the user input device 104 to move the hospital bed 10 from the chair egress position shown in FIGS. 11 and 12 to bed position of FIG. 1, the foot deck section raise drive 78 will pivot the foot deck section 32 relative to the thigh deck section 38. While the foot deck section 32 is pivoted, the foot section extension drive 82 will begin to extend the extension 44 of the foot deck section 32 relative to the base 42 of the foot deck section 32. If the sensor 86 detects the floor 16, the foot section extension drive 82 will be interrupted until the sensor 86 no longer detects the floor 16 due to pivoting of the foot deck section 38. The remainder of the frame and deck members will be driven by the respective drives 60, 62, 68, 74, 78, and 82 with drives being interrupted as necessary if any of the sensors 84, 86, 88, 90, or 100 detect the proximity of one of the frame or deck members to an obstruction. In some embodiments, detection of an obstruction will cause the controller 52 to vary the speed of one or more of the drives 60, 62, 68, 74, 78, and 82 until the obstruction is no longer detected.

It should be understood that while user input devices 94 and 104 have been discussed herein in detail, other user input devices may also be used to move specific frame or deck section members. For example, in some embodiments, the user interface 58 will include user input devices for controlling movement of any of the drives 60, 62, 68, 74, 78, and 82 to extend while other user input devices will control movement of any of the drives 60, 62, 68, 74, 78, and 82 to retract.

The sensors 84, 86, 88, 90, or 100 may be any of several types of sensing devices that detect the presence of a body. For example, the sensors could be Hall effect sensors, contact switches, force sensing devices, photo diode array devices, ultrasonic devices, optical sensors detecting shapes, or other proximity or contact switch devices known in the art. In some embodiments, the sensors 84, 86, 88, 90, or 100 may actually contact an obstruction to sense the proximity of a frame or deck member to the obstruction.

In operation, the controller 52 monitors the potentiometers in the drives 60, 62, 68, 74, 78, and 82, the sensors 84, 86, 88, 90, or 100, and the user input devices 94 and 104. The processor 96 of the controller 52 utilizes instructions stored in memory device 98 to determine when to drive the drives 60, 62, 68, 74, 78, and 82 and in what direction to drive the drives 60, 62, 68, 74, 78, and 82 to achieve a position desired by a user. The controller 52 utilizes the data from potentiometers in the drives 60, 62, 68, 74, 78, and 82, the sensors 84, 86, 88, 90, or 100, and the user input devices 94 and 104 and drives the drives 60, 62, 68, 74, 78, and 82 to the desired position as quickly as possible. If one or more of the sensors 84, 86, 88, 90, or 100 indicates that a member of the frame or deck of the patient support apparatus has encountered an instruction in the form of another member or some external obstruction, such as the floor, for example, the controller 52 modifies operation of one or more of the drives 60, 62, 68, 74, 78, and 82 to prevent contact with the obstruction. The operation of the drives 60, 62, 68, 74, 78, and 82 is optimized to achieve the desired position as quickly as possible by allowing the members to move as near as the obstruction as safely possible without having the member contact the obstruction.

Although the invention has been described with reference to the preferred embodiments, variations and modifications exist within the scope and spirit of the invention as described and defined in the following claims.

The invention claimed is:

1. A patient support apparatus comprising a lower frame, an upper frame movable relative to the lower frame, a first sensor positioned on one of the upper frame and the lower frame, the sensor having a sensing field and transmitting a signal when the first sensor detects a body in the sensing field; and a control system including a controller coordinating movement of the upper frame relative to the lower frame, the controller receiving a signal from the first sensor and responding to the first sensor to control movement of the upper frame by changing the speed at which the upper frame moves relative to the lower frame-by varying the speed of one or more drives until the obstruction is no longer detected wherein the patient support apparatus further comprises a patient support deck section supported on the upper frame and a second sensor positioned on the patient support deck, the patient support deck section movable relative to the upper frame, wherein the controller modifies the movement of the upper frame relative to the lower frame if movement of the upper frame is being requested and the first sensor detects a body in the sensing field, wherein the controller modifies the movement of the patient support deck section relative to the upper frame if movement of the patient support deck section is being requested and the second sensor detects a body in the sensing field.

2. The patient support apparatus of claim 1, wherein the first sensor is positioned such that the other of the upper frame and lower frame that the first sensor is not positioned on is the body detected by the first sensor when movement the upper frame relative to the lower frame causes the other of the upper frame and lower frame that the first sensor is not positioned on to be in the sensing field.

3. The patient support apparatus of claim 2, wherein the controller modifies the movement of the upper frame relative to the lower frame if movement of the upper frame is being requested and the first sensor detects a body in the sensing field.

4. The patient support apparatus of claim 1, wherein the patient support apparatus further comprises a lift system coupled to the control system, the lift system moving the upper frame relative to the lower frame, the control system controlling the movement of the lift system.

5. The patient support apparatus of claim 4, wherein the lift system is operable to tilt the upper frame relative to the lower frame.

6. The patient support apparatus of claim 1, wherein the first sensor is positioned on the upper frame to detect the floor when the upper frame approaches the floor.

7. The patient support apparatus of claim 6, wherein the control system is operable to stop operation of portions of the patient support apparatus when the first sensor detects a body in the sensing field.

8. The patient support apparatus of claim 7, wherein the control system is operable to change the speed of operation of portions of the patient support apparatus when the first sensor detects a body in the sensing field.

9. The patient support apparatus of claim 8, wherein the first sensor forms a magnetic field.

10. The patient support apparatus of claim 8, wherein the first sensor forms a light field.

11. A patient support apparatus comprising a base frame, an upper frame movable relative to the base frame, a plurality of deck sections supported on the upper frame, the deck sections movable relative to the upper frame, and including at least one deck section that is both pivotable relative to the upper frame and variable in size, a first sensor positioned on one of the frames, a second sensor positioned on the at least one deck section that is both pivotable relative to the upper frame and variable in size, and a control system including a controller coordinating movement of the upper frame relative to the lower frame and coordinating movement of the deck sections relative to the upper frame, the controller receiving a signal from the first sensor and responding to the first sensor to control movement of the upper frame if the first sensor detects that the upper frame is proximate the base frame, the controller further receiving a signal from the second sensor and responding to the second sensor to control movement of the at least one deck section that is both pivotable relative to the upper frame and variable in size if the second sensor detects that the at least one deck section that is both pivotable relative to the upper frame and variable in size is proximate an obstruction.

12. The patient support apparatus of claim 11, wherein the second sensor detects that the at least one deck section that is both pivotable relative to the upper frame and variable in size is proximate the floor.

13. The patient support apparatus of claim 12, wherein the patient support apparatus includes a first drive to pivot the at least one deck section that is both pivotable relative to the upper frame and variable in size relative to the upper frame and a second drive to extend and retract said at least one deck section that is both pivotable relative to the upper frame and variable in size.

14. The patient support apparatus of claim 13, wherein the movement of one of the first and second drives is interrupted if the second sensor detects an obstruction, while the movement of the other of the first and second drives is continued.

15. The patient support apparatus of claim 14, wherein the at least one deck section that is both pivotable relative to the upper frame and variable in size is a foot deck section and the foot deck section continues to retract in size if the second sensor detects an obstruction while the pivoting of the foot deck section is interrupted until the second sensor no longer detects an obstruction.

16. The patient support apparatus of claim 15, wherein the obstruction detected is the floor supporting the patient support apparatus.

17. The patient support apparatus of claim 16, wherein the patient support apparatus further comprises at least two drives that move the upper frame relative to the base frame, the controller controlling operation of the at least two drives that move the upper frame relative to the base frame, wherein operation of one of the at least two drives that move the upper frame relative to the base frame is interrupted while the foot deck section continues to retract in size if the second sensor detects an obstruction and wherein the one of the at least two drives that move the upper frame relative to the base frame that has been interrupted continues to operate when the second sensor no longer detects an obstruction.

18. The patient support apparatus of claim 11, wherein the first sensor is a non-contact sensor and configured to detect that the upper frame is proximate the base frame prior to the upper frame contacting the base frame.

19. A patient support apparatus comprising a base frame, an upper frame movable relative to the base frame, a deck section, having a length extending in the longitudinal direction and a width extending in the transverse direction, supported on the upper frame, the deck section being pivotable relative to the upper frame about a pivot axis and variable in size such that the longitudinal length of the deck section measured from the pivot axis to the longitudinal end of the deck section varies, a first sensor positioned on the deck section, and a control system including a controller coordinating movement of the upper frame relative to the lower frame and coordinating movement of the deck section relative to the upper frame, the controller receiving a signal from the first sensor and responding to the signal to control movement of the upper frame and the deck section if the first sensor detects that the deck section is proximate an obstruction.

20. The patient support apparatus of claim 19, wherein the patient support apparatus includes a first drive to pivot the deck section relative to the upper frame and a second drive to extend and retract said at least one deck section, wherein the movement of one of the first and second drives is interrupted if the first sensor detects an obstruction, while the movement of the other of the first and second drives is continued.

21. The patient support apparatus of claim 20, wherein the obstruction detected is the floor supporting the patient support apparatus.

22. The patient support apparatus of claim 19, further comprising a second sensor positioned on one of the upper frame and base frame, wherein the controller receives a signal from the second sensor and responds to the second sensor to control movement of the upper frame if the second if the second sensor detects an obstruction between the upper frame and the lower frame.

* * * * *